United States Patent [19]

Sanada et al.

[11] 4,175,527

[45] Nov. 27, 1979

[54] FUEL SUPPLY SYSTEM FOR ENGINES

[75] Inventors: Masakatsu Sanada; Toshimitsu Ito, both of Toyota; Masahiko Nakada, Okazaki, all of Japan

[73] Assignee: Toyota Jidosha Kogyo Kabushiki Kaisha, Toyota, Japan

[21] Appl. No.: 809,759

[22] Filed: Jun. 24, 1977

[30] Foreign Application Priority Data

Mar. 22, 1977 [JP] Japan ..... 52/31357

[51] Int. Cl.[2] ..... F02M 59/00

[52] U.S. Cl. ..... 123/136; 123/127

[58] Field of Search ..... 123/127, 136, 3

[56] References Cited

U.S. PATENT DOCUMENTS

| | | | |
|---|---|---|---|
| 1,953,808 | 4/1934 | Kenneweg | 123/136 |
| 3,713,429 | 1/1973 | Dwyer | 123/127 |
| 3,768,454 | 10/1973 | Markland | 123/136 |
| 3,807,377 | 4/1974 | Hirschler | 123/127 |
| 4,031,864 | 6/1977 | Crothers | 123/136 |

*Primary Examiner*—Ronald B. Cox

*Attorney, Agent, or Firm*—Stevens, Davis, Miller & Mosher

[57] ABSTRACT

A fuel supply system for engines, including a fuel tank divided into first and second chambers, a fuel supply passage means including a fuel pump and supplying fuel from the fuel tank to a carburetor of the engine and a fuel return passage means for returning the excess fuel supplied to the carburetor to the second chamber of the fuel tank. An upper region of the second chamber is bled, while the first chamber is supplied with new fuel, the fuel supply passage means including a change-over valve which usually connects the fuel supply passage to the first chamber, while it connects the fuel supply passage to the second chamber when the fuel temperature has risen beyond a predetermined value.

8 Claims, 5 Drawing Figures

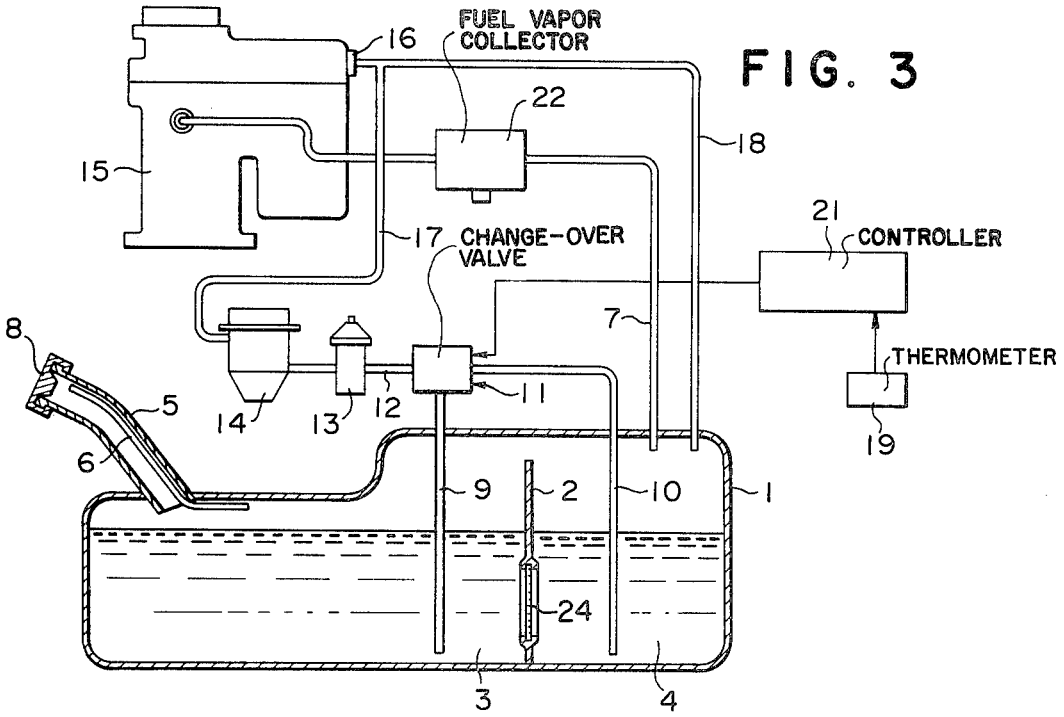
FIG. 3
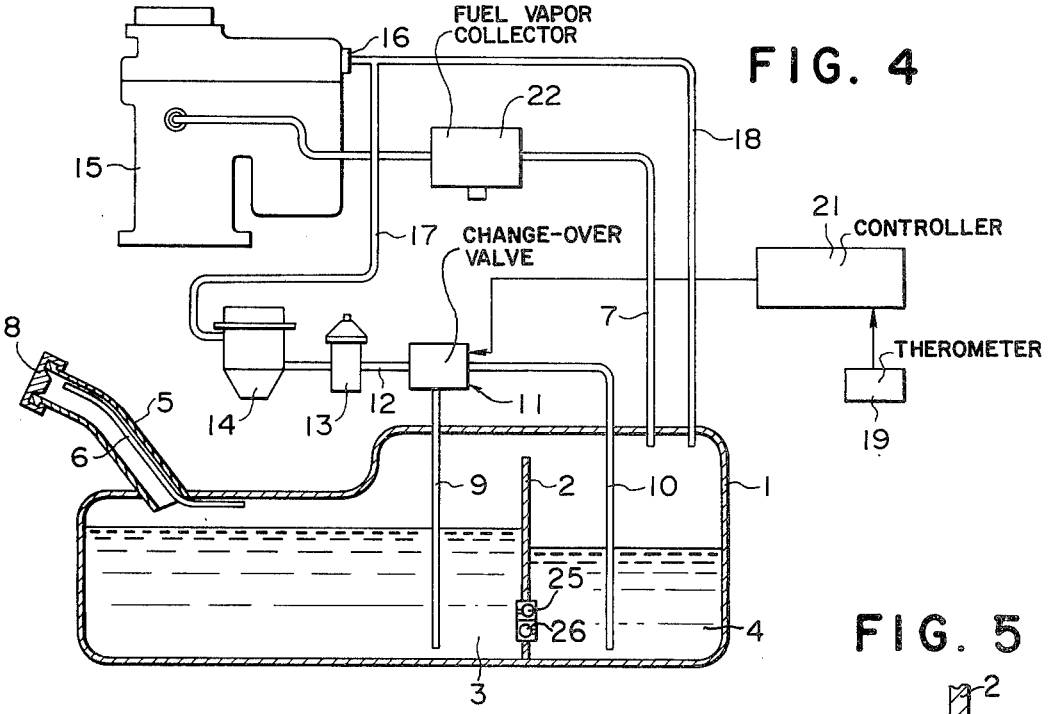
FIG. 4
FIG. 5
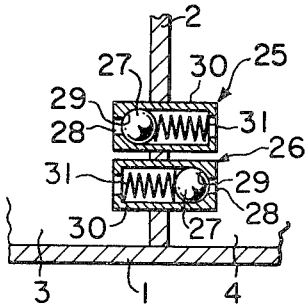

FUEL SUPPLY SYSTEM FOR ENGINES

BACKGROUND OF THE INVENTION

The present invention relates to a fuel supply system for engines and, more particularly, an improved fuel supply system for gasoline engines having a carburetor.

The gasoline engines for automobiles which incorporate an exhaust gas recombustion system such as a catalytic converter or a thermal reactor in order to meet the regulations with regard to engine emission generally cause a higher engine environment temperature which in turn is liable to cause an overheating of the fuel existing in the fuel supply system for the engine including the carburetor. If the temperature of the fuel exceeds 50° C., it violently evaporates, thereby generating a lot of bubbles in the fuel supply system, resulting in obstruction of the correct control of air/fuel ratios, unstable rotation of the engine, and an increase in the emission of harmful gas components.

In normal operation of automobiles, the fuel supply system means such as the carburetor and other fuel supply passage means are provided with a cooling effect by the flow of intake air and the heat-absorbing evaporation of fuel. However, when the engine is brought to idling operation or stop subsequent to high-speed high-load operation, the fuel supply system is very liable to overheat. If the fuel existing in the fuel supply system is overheated, the viscosity of fuel greatly lowers and causes an unacceptable change of the flow coefficient of the jet means incorporated in the carburetor. Furthermore, the fuel existing in the float chamber and other passages of the carburetor causes boiling and generates a lot of bubbles. These bubbles carry fuel droplets and take them into the air passage of the carburetor and so-called percolation occurs. If percolation occurs, the carburetor generates an over-rich fuel-air mixture which causes unstable operation of the engine, an increase of emission of uncombusted harmful components and poor restartability of the engine.

Furthermore, if the fuel bubbles are generated in the carburetor or other fuel supply passage means, they interrupt the flow of fuel therethrough and cause so-called vapor-locking. If vapor-locking occurs at any part of the fuel supply passage means, the supply of fuel is impeded and in the worst case the engine stops. Even when the engine does not stop, misfiring is caused. It is known that the abovementioned percolation or vapor-locking is caused principally by light components having low boiling points included in gasoline.

In order to avoid percolation or vapor-locking, it has been proposed, and practiced, to feed an excessive amount of fuel from the fuel tank to the carburetor by employing a fuel pump having a large excess capacity, so that a substantial flow of fuel is always maintained in the fuel pump and the fuel supply passage means in order to avoid any undesirable temperature rise of the fuel supply system. This system is generally called a fuel return system, and is effective for reducing the occurence of percolation or vapor-locking. However, this system is not yet perfectly free from percolation or vapor-locking.

SUMMARY OF THE INVENTION

As a result of various experimental research for definitely avoiding percolation or vapor-locking, we have found that in the fuel return system the fuel which is returned through a fuel return pipe is composed substantially of medium and heavy components while lacking light components and is therefore less volatile compared with fuel newly supplied from the fuel tank.

The present invention depends upon the abovementioned discovery and contemplates changing over the supply of fuel between new fuel and the once-returned fuel in accordance with the possibility of causing percolation or vapor-locking in a manner such that when the engine operating condition is likely to cause percolation or vapor-locking, the once-returned fuel is supplied to the carburetor.

In accordance with the abovementioned basic concept, the present invention proposes a fuel supply system for engines having a carburetor, comprising a fuel tank, a fuel supply passage means for supplying fuel from said fuel tank to the carburetor, a fuel pump incorporated in said fuel supply passage means, a fuel return passage means for returning excess fuel supplied to the carburetor, a thermometer for sensing a temperature which represents the temperature of fuel, said fuel tank having a fuel supply port, a first chamber for receiving fuel supplied from said fuel supply port, and a second chamber for receiving fuel from said return passage means, a change-over valve incorporated in said fuel supply passage means for changing over connection of said fuel pump to said first and second chambers, a vapor bleed passage means for bleeding an upper region of said second chamber, and means for controlling the changing-over operation of said change-over valve in accordance with the temperature sensed by said thermometer.

BRIEF DESCRIPTION OF THE DRAWING

The present invention will become more fully understood from the detailed description given herein below and the accompanying drawings which are given by way of illustration only and are therefore not limitative of the present invention and wherein:

FIGS. 1–4 are diagrammatical views showing several embodiments of the fuel supply system for engines constructed in accordance with the present invention; and FIG. 5 is a sectional view of an embodiment of the check valve incorporated in the fuel supply system shown in FIG. 4.

DESCRIPTION OF THE PREFERRED EMBODIMENTS

Figure 1:
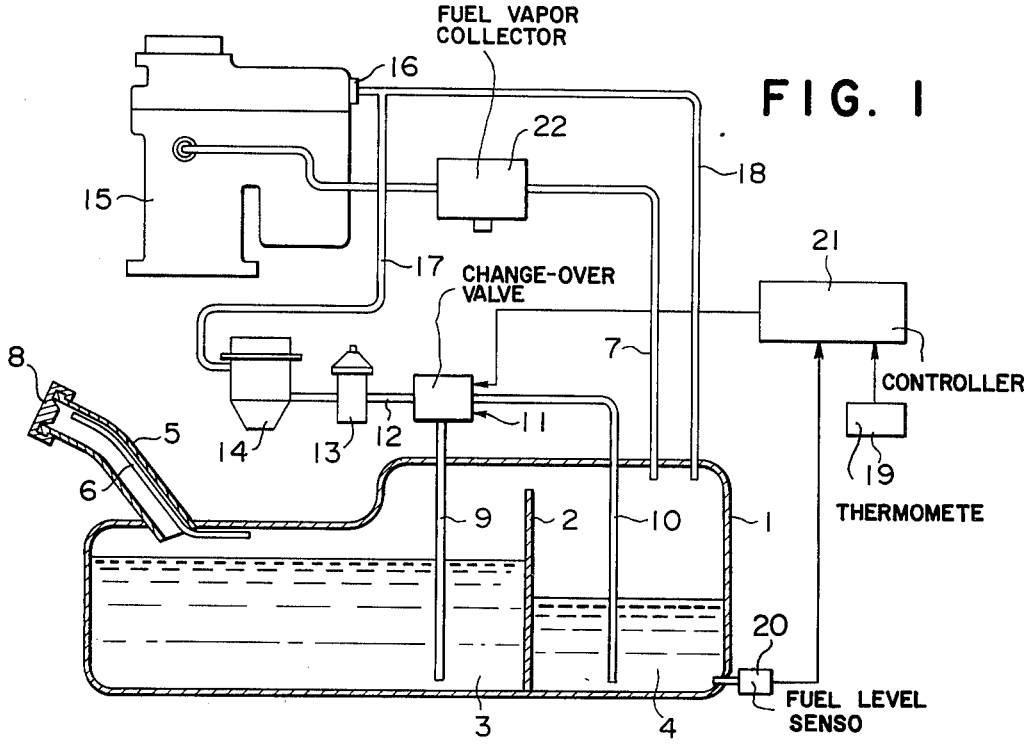
Figure 2:
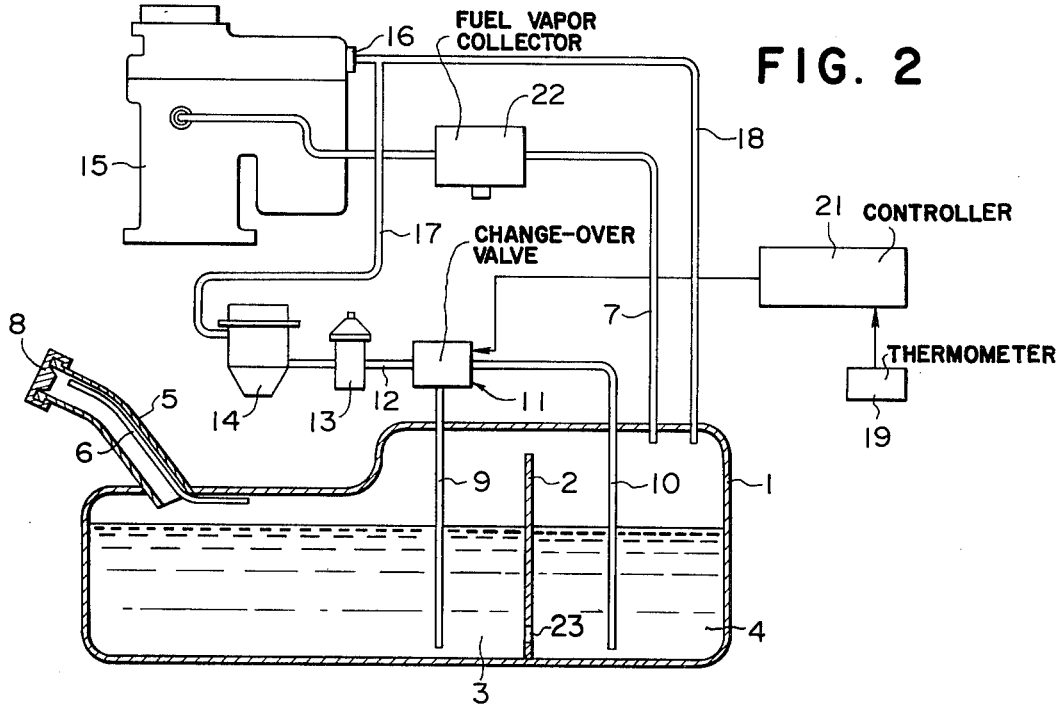

Referring to FIG. 1 showing the first embodiment of the fuel supply system for engines according to the present invention, 1 designates a fuel tank having a closed internal space which is divided by a partition 2 in order to provide first and second fuel storing chambers 3 and 4. The first chamber 3 is adapted to be supplied with a new supply of gasoline from a supply port defined by a fuel supply pipe 5. The partition 2 must be high enough to separate the maximum quantities of fuel in the chambers 3 and 4 from each other and should preferably be a little short of the total height of the tank so that a connecting passage is provided between the two chambers adjacent to the ceiling of the tank. By providing the connecting passage, only one set of an air bleed pipe 6 and a vapor bleed pipe 7 need be provided for the two chambers 3 and 4 instead of providing each with a separate set. The air bleed pipe 6 serves to exhaust the air contained in the tank when fuel is charged into the fuel tank so that the fuel is smoothly charged into the tank. The air bleed pipe is generally provided along the internal wall of the fuel supply pipe 5. A cap 8 is mounted to the outer end of the fuel supply pipe 5.

First and second fuel take-out pipes 9 and 10 are provided in the first and second fuel storing chambers 3 and 4 respectively and are adapted to be selectively connected to a fuel intake pipe 12 by a change-over valve 11. The fuel intake pipe 12 includes a strainer 13 at a middle portion thereof and is connected to the inlet port of a fuel pump 14. The fuel pump 14 may be of any conventional type such as a diaphragm pump driven by cam means, an electromagnetic pump, etc. The outlet port of the fuel pump 14 is connected to a fuel inlet port 16 of a carburetor 15 by a fuel delivery pipe 17. The fuel inlet port 16 of the carburetor is also connected with a fuel return pipe 18 for returning excess fuel supplied from the fuel delivery pipe 17 to the fuel tank 1. The fuel return pipe 18 opens toward the second chamber 4 in the fuel tank.

A block 19 diagrammatically shows a thermometer for sensing a temperature which represents the temperature of the fuel existing in the fuel supply system including the carburetor and other fuel passage means. For example, the thermometer 19 may sense the air temperature in the engine compartment. Another sensor 20 is provided to ascertain whether the second chamber 4 contains fuel or not. The outputs from the thermometer 19 and the fuel sensor 20 are supplied to a controller 21 which dispatches a signal for controlling the change-over valve 11. The controller 21 operates in a manner such that, if the thermometer 19 senses a high temperature which possibly could cause percolation or vapor-lock, while the fuel sensor 20 detects that fuel exists in the second chamber 4, it changes over the change-over valve 11 so as to connect the fuel take-out pipe 10 to the fuel intake pipe 12, whereas it changes over the change-over valve 11 so as to connect the fuel take-out pipe 9 to the fuel intake pipe 12 in the other operating conditions. Or alternatively, the change-over valve 11 may be of a stageless type which gradually connects the fuel take-out pipe 10 to the fuel intake pipe 12 while gradually disconnecting the fuel take-out pipe 9 from the fuel intake pipe 12 or vice-versa so as to provide various medium change-over conditions in accordance with the temperature of the fuel. The controller 21 may be a simple electric change-over circuit including a conventional AND circuit. In accordance with such a structure of the controller 21, the change-over valve 11 may be an electromagnetic valve which operates in accordance with the electric signals supplied from the controller.

7 designates a vapor bleed pipe connected to a vapor collecting means 22 such as a charcoal canister. The fuel vapor which was once collected by the collecting means 22 is drawn toward the intake passage of the carburetor during the operation of the engine.

When the temperature of the fuel contained in the fuel supply system is so low that there is no danger of causing percolation or vapor-locking, the change-over valve 11 connects the first fuel take-out pipe 9 to the fuel intake pipe 12, whereby fuel in the first chamber 3 is fed through the take-out pipe 9, change-over valve 11, fuel intake pipe 12, strainer 13, fuel pump 14, and fuel delivery pipe 17 by the pumping action of the fuel pump 14. The main part of the fuel supplied through the fuel delivery pipe 17 is fed through the fuel inlet port 16 of the carburetor 15 to the float chamber (not shown) in the carburetor, while the excess part is returned through the fuel return pipe 18 to the second fuel storing chamber 4. Since the fuel passed through all the abovementioned passages and returned to the chamber 4 is substantially heated, relatively volatile light components included in the fuel evaporate in the chamber 4 and the vapors flow through the vapor bleed pipe 7 to the vapor collecting means 22, where they are temporarily collected. On the other hand, medium and heavy components of the fuel remain as liquids in the chamber 4.

When the temperature of fuel has risen so high that there is a danger of causing percolation or vapor-locking, as in idling operation after high-speed high-load operation, the high temperature of the fuel is sensed by the thermometer 19. If in this case the sensor 20 is detecting that the second chamber 4 has an amount of liquid fuel, the controller 21 dispatches a signal to the change-over valve 11 and changes over the valve so as to connect the second fuel take-out pipe 10 to the fuel intake pipe 12 while disconnecting the first fuel take-out pipe 9 from the fuel intake pipe 12. Consequently, the less volatile components of the gasoline now stored in the second chamber 4 are now fed through the second fuel take-out pipe 10, change-over valve 11, fuel intake pipe 12, strainer 13, fuel pump 14, and fuel delivery pipe 17 to the inlet port 16 of the carburetor. By supplying the less volatile components of gasoline under a higher temperature condition of fuel, the occurrence of percolation or vapor-locking is effectively avoided.

If the liquid fuel in the second chamber 4 has been exhausted, the sensor 20 detects this and, in accordance with the operation of the controller 21, the change-over valve 11 is changed over so as to connect the first fuel take-out pipe 9 to the fuel intake pipe 12. However, in actual operation the high fuel temperature such as to cause percolation or vapor-locking is generally removed before the fuel in the second chamber 4 is exhausted.

FIGS. 2–5 show other embodiments of the fuel supply system according to the present invention. In these figures the portions corresponding to those shown in FIG. 1 are designated by the same reference numerals. In the embodiment shown in FIG. 2, the partition 2 is formed with a small through opening 23 adjacent to the lower end portion thereof so as to connect the bottom regions of the first and second chambers 3 and 4 with each other. In this embodiment the liquid fuel contained in the two chambers compensates each other so that the both chambers always maintain a common liquid level. In this case, therefore, the sensor 20 for detecting a shortage of liquid fuel in the second chamber 4 is not required. Although there occurs a mixing of the liquids contained in the chambers 3 and 4 through the opening 23, the mixing is generally so moderate that it does not affect the operation of the fuel supply system of the present invention.

In the embodiment shown in FIG. 3, the partition 2 incorporates therein a perforated portion 24 instead of the aforementioned small opening 23. The perforated portion 24 also effects a moderate compensating flow between the chambers 3 and 4.

In the embodiment shown in FIG. 4, the partition 2 has a combination of first and second check valves 25 and 26, wherein the first check valve 25 is adapted to allow fluid to flow from the first chamber 3 to the second chamber 4 while the second check valve 26 is adapted to allow fluid to flow from the second chamber 4 to the first chamber 3. As shown in FIG. 5, the first and second check valves 25 and 26 individually have a check ball 27, a valve casing 30 receiving the check ball and providing a port 28 and a valve seat 29 and a compression coil spring 31 which urges the check ball 27 onto the valve seat 29. The check valves 25 and 26 are of the same structure but are different from each other in their mounting directions. The check valves 25 and 26 are individually adapted to be opened when a predetermined static pressure difference is applied across them so as to effect mutual compensation of the liquid fuel contained in the chambers 3 and 4. In this case, therefore, the sensor 20 such as provided in the embodiment shown in FIG. 1 may be omitted. The mixing of the two liquid fuels effected through the check valves 25 and 26 is actually very moderate and does not affect the operation of the fuel supply system of the present invention.

Although the invention has been shown and described with respect to some preferred embodiments thereof, it should be understood by those skilled in the art that various changes and omissions of the form and details thereof may be made therein without departing from the scope of the invention.

We claim:

1. A fuel supply system, for an internal combustion engine equipped with a carburetor, comprising:

a fuel tank which comprises a fuel supply port, a first chamber which receives fuel supplied into the fuel supply port, and a second chamber;

a fuel supply passage means, which supplies fuel from the fuel tank to the carburetor, and which incorporates a fuel pump and a change-over valve which changes over connection of the fuel supply passage means between the first and the second chamber of the fuel tank;

a fuel return passage means, which returns excess fuel supplied to the carburetor back to the second chamber of the fuel tank;

a thermometer which senses a temperature which represents the temperature of the fuel;

a vapor bleed passage means for bleeding vapor out of the upper region of the second chamber;

and a controller which controls the operation of the change-over valve in accordance with the temperature sensed by the thermometer, so that the fuel in the second chamber is supplied to the carburetor only when the temperature sensed by the thermometer is higher than a predetermined value.

2. The system of claim 1, further comprising a sensing means which detects whether liquid fuel is in the second chamber or not, and which dispatches a signal to the controller, wherein the controller connects the fuel supply passage means to the second chamber only when both the temperature sensed by the thermometer is higher than the said predetermined value and also the sensing means is detecting presence of fuel in the second chamber.

3. The system of claim 1, wherein a partition is provided to separate said first and second chambers, said partition having a means to connect said first and second chambers to each other in the bottom region thereof.

4. The system of claim 3, wherein said means provided in said partition for connecting said first and second chambers is a small opening formed in said partition.

5. The system of claim 3, wherein said means provided in said partition for connecting said first and second chambers is a perforated portion incorporated in said partition.

6. The system of claim 3, wherein said means provided in said partition for connecting said first and said second chambers is a combination of two check valves arranged in opposite directions, each check valve having a valve seat, a valve element, and a spring for biasing said valve element towards said valve seat with a predetermined spring force.

7. The system of claim 1, wherein said vapor bleed passage means is connected to said carburetor and incorporates therein a charcoal canister.

8. The system of claim 1, wherein a partition is provided to separate said first and second chambers, said partition being shorter than the total height of the tank space so that the first and second chambers are connected to each other in the top region thereof.

* * * * *